US012140358B2

(12) United States Patent
Yamada et al.

(10) Patent No.: US 12,140,358 B2
(45) Date of Patent: Nov. 12, 2024

(54) REFRIGERANT CYCLE SYSTEM

(71) Applicant: DAIKIN INDUSTRIES, LTD., Osaka (JP)

(72) Inventors: Takuro Yamada, Osaka (JP); Eiji Kumakura, Osaka (JP); Atsushi Yoshimi, Osaka (JP); Ikuhiro Iwata, Osaka (JP); Tomoatsu Minamida, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 266 days.

(21) Appl. No.: 17/608,913

(22) PCT Filed: Jun. 10, 2020

(86) PCT No.: PCT/JP2020/022923
§ 371 (c)(1),
(2) Date: Nov. 4, 2021

(87) PCT Pub. No.: WO2020/250953
PCT Pub. Date: Dec. 17, 2020

(65) Prior Publication Data

US 2022/0316765 A1 Oct. 6, 2022

(30) Foreign Application Priority Data

Jun. 12, 2019 (JP) ..... 2019-109594

(51) Int. Cl.
*F25B 39/04* (2006.01)
*F25B 7/00* (2006.01)
(Continued)

(52) U.S. Cl.
CPC ..... *F25B 7/00* (2013.01); *F25B 13/00* (2013.01); *F25B 39/022* (2013.01); *F25B 39/04* (2013.01);
(Continued)

(58) Field of Classification Search
CPC ..... F25B 41/40; F25B 7/00; F25B 39/022; F25B 39/04; F25B 2400/13; F25B 2339/0241; F25B 2339/043
See application file for complete search history.

(56) References Cited

U.S. PATENT DOCUMENTS

2004/0031598 A1 2/2004 Shimanuki et al.
2014/0260404 A1 9/2014 Verma et al.
(Continued)

FOREIGN PATENT DOCUMENTS

CN 101014818 A 8/2007
EP 1844286 A2 10/2007
(Continued)

OTHER PUBLICATIONS

Extended European Search Report issued in corresponding European Application No. 20821882.6 mailed May 20, 2022 (7 pages).
(Continued)

*Primary Examiner* — Frantz F Jules
*Assistant Examiner* — Martha Tadesse
(74) *Attorney, Agent, or Firm* — Osha Bergman Watanabe & Burton LLP

(57) ABSTRACT

A refrigerant cycle system includes: a primary-side cycle of a vapor compression type that circulates a first refrigerant; a secondary-side cycle of a vapor compression type that circulates a second refrigerant; and a cascade heat exchanger that exchanges heat between the first refrigerant and the second refrigerant. The secondary-side cycle includes a secondary-side heat exchanger that uses cold or heat
(Continued)

obtained by the second refrigerant from the cascade heat exchanger. The secondary-side heat exchanger includes a flat multi-hole pipe.

3 Claims, 2 Drawing Sheets

(51) Int. Cl.

| | |
|---|---|
| ***F25B 13/00*** | (2006.01) |
| ***F25B 39/02*** | (2006.01) |
| ***F25B 41/31*** | (2021.01) |
| ***F25B 41/40*** | (2021.01) |

(52) U.S. Cl.
CPC ..... *F25B 41/31* (2021.01); *F25B 41/40* (2021.01); *F25B 2313/0233* (2013.01); *F25B 2339/0241* (2013.01); *F25B 2339/043* (2013.01); *F25B 2400/13* (2013.01)

(56) References Cited

U.S. PATENT DOCUMENTS

| | | | | |
|---|---|---|---|---|
| 2016/0320105 | A1* | 11/2016 | Okazaki | F25B 7/00 |
| 2021/0333021 | A1* | 10/2021 | Matsuoka | F25B 29/00 |

FOREIGN PATENT DOCUMENTS

| | | | | |
|---|---|---|---|---|
| EP | 3098540 | A1 | 11/2016 | |
| EP | 3643988 | A1 | 4/2020 | |
| EP | 3812662 | A1 | 4/2021 | |
| JP | 2002-130979 | A | 5/2002 | |
| JP | 2014-74508 | A | 4/2014 | |
| WO | 2015/111175 | A1 | 7/2015 | |
| WO | 2017/130399 | A1 | 8/2017 | |
| WO | WO-2018235832 | A1 * | 12/2018 | F25B 13/00 |
| WO | 2020/004108 | A1 | 1/2020 | |

OTHER PUBLICATIONS

International Preliminary Report on Patentability issued in corresponding International Application No. PCT/JP2020/022923 dated Dec. 14, 2021 (6 pages).

International Search Report issued in corresponding International Application No. PCT/JP2020/022923, mailed on Sep. 1, 2020 (6 pages).

Written Opinion issued in corresponding International Application No. PCT/JP2020/022923, mailed on Sep. 1, 2020 (4 pages).

* cited by examiner

REFRIGERANT CYCLE SYSTEM

TECHNICAL FIELD

The present disclosure relates to a refrigerant cycle system including a cascade heat exchanger.

BACKGROUND

PTL 1 (Japanese Laid-Open Patent Publication No. 2014-74508) discloses a refrigerant cycle system including a cascade heat exchanger.

There may be a difference between an amount of refrigerant that a refrigerant cycle system requires in heating operation and an amount of refrigerant that the refrigerant cycle system requires in cooling operation. The difference is caused by a difference between a capacity (i.e., volume) of the cascade heat exchanger and a capacity (i.e., volume) of a usage heat exchanger. When the difference is large, the refrigerant cycle system needs to store a large amount of refrigerant for heating operation or cooling operation that requires a larger amount of refrigerant. There is however a demand to reduce the amount of refrigerant charged into the refrigerant cycle system.

SUMMARY

A refrigerant cycle system according to a first aspect includes a vapor compression primary-side cycle that circulates a first refrigerant, a vapor compression secondary-side cycle that circulates a second refrigerant, and a cascade heat exchanger that exchanges heat between the first refrigerant and the second refrigerant. The secondary-side cycle includes a secondary-side heat exchanger for using cold or heat obtained by the second refrigerant from the cascade heat exchanger. The secondary-side heat exchanger includes a flat multi-hole pipe.

According to this configuration, the secondary-side heat exchanger includes a flat multi-hole pipe. Heat exchangers of a type that includes a flat multi-hole pipe tend to have a small capacity. Therefore, a difference between the capacity of the cascade heat exchanger and the capacity of the secondary-side heat exchanger is small. It is thus possible to reduce the amount of refrigerant charged into the refrigerant cycle system.

A refrigerant cycle system according to a second aspect is the refrigerant cycle system according to the first aspect in which the flat multi-hole pipe includes a refrigerant flow path having a hole diameter of 0.05 mm or more and 2.0 mm or less.

A refrigerant cycle system according to a third aspect is the refrigerant cycle system according to the first aspect or the second aspect in which the cascade heat exchanger is a plate heat exchanger.

A refrigerant cycle system according to a fourth aspect is the refrigerant cycle system according to any one of the first aspect to the third aspect in which the cascade heat exchanger includes a first refrigerant passage that allows the first refrigerant to pass therethrough and a second refrigerant passage that allows the second refrigerant to pass therethrough. The relationship between a first capacity V1 that is a capacity of the secondary-side heat exchanger and a second capacity V2 that is a capacity of the second refrigerant passage of the cascade heat exchanger is as follows.

$$0.80 \leq \frac{V1}{V2} \leq 1.20$$

A refrigerant cycle system according to a fifth aspect is the refrigerant cycle system according to any one of the first aspect to the fourth aspect in which the refrigerant cycle system includes a plurality of secondary-side cycles and a plurality of cascade heat exchangers.

DETAILED DESCRIPTION

First Embodiment (1) Overall Configuration

Figure 1:
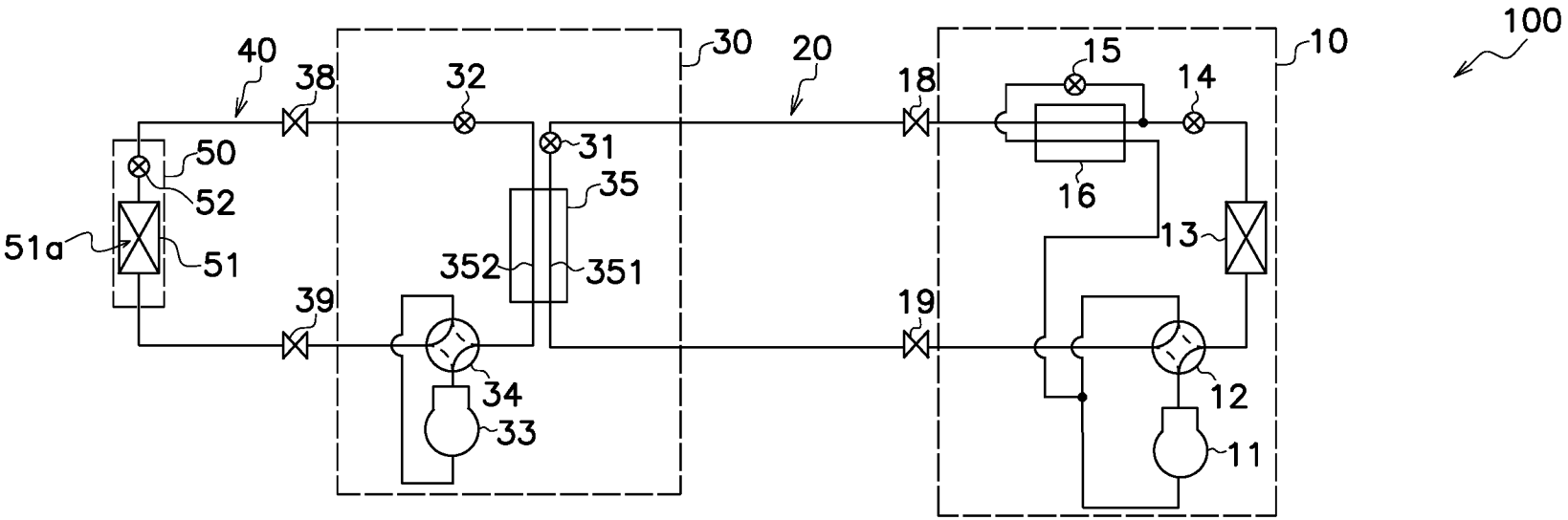
FIG. 1 is a view illustrating a refrigerant cycle system 100 according to a first embodiment.

FIG. 1 illustrates a refrigerant cycle system 100. The refrigerant cycle system 100 is configured to acquire cold or heat from a heat source and supply the cold or the heat to a user.

The refrigerant cycle system 100 includes a heat source unit 10, a cascade unit 30, and a usage unit 50.

The heat source unit 10 and the cascade unit 30 are connected to each other to configure a vapor compression primary-side cycle 20. The primary-side cycle 20 is a circuit that circulates a first fluid. The first fluid is a refrigerant.

The cascade unit 30 and the usage unit 50 are connected to each other to configure a vapor compression secondary-side cycle 40. The secondary-side cycle 40 is a circuit that circulates a second fluid. The second fluid is a refrigerant. The first fluid and the second fluid may be the same refrigerant and may be different refrigerants.

(2) Detailed Configuration (2-1) Heat Source Unit 10

The heat source unit 10 acquires cold or heat from outside air that is a heat source. The heat source unit 10 includes a compressor 11, a four-way switching valve 12, a heat-source heat exchanger 13, a heat-source expansion valve 14, a subcooling expansion valve 15, a subcooling heat exchanger 16, a liquid shutoff valve 18, and a gas shutoff valve 19.

The compressor 11 sucks and compresses low-pressure gas refrigerant that is the first fluid and discharges high-pressure gas refrigerant. The four-way switching valve 12 makes connection indicated by the solid lines in FIG. 1 during cooling operation and makes connection indicated by the broken lines in FIG. 1 during heating operation. The heat-source heat exchanger 13 exchanges heat between the first fluid and outside air. The heat-source heat exchanger 13 functions as a condenser during cooling operation and functions as an evaporator during heating operation. The heat-source expansion valve 14 adjusts the flow rate of the first fluid. The heat-source expansion valve 14 also functions as a decompression device that decompresses the first fluid.

The subcooling expansion valve 15 produces cooling gas by decompressing the first fluid that circulates. The subcooling heat exchanger 16 exchanges heat between the first fluid that circulates and the cooling gas, thereby giving a degree of subcooling to the first fluid.

The liquid shutoff valve 18 and the gas shutoff valve 19 shut off a flow path in which the first fluid circulates, for example, during work of installation of the heat source unit 10.

(2-2) Cascade Unit 30

The cascade unit 30 is configured to exchange heat between the first fluid and the second fluid.

The cascade unit 30 includes a primary-side expansion valve 31, a secondary-side expansion valve 32, a compressor 33, a four-way switching valve 34, a cascade heat exchanger 35, a liquid shutoff valve 38, and a gas shutoff valve 39.

The primary-side expansion valve 31 adjusts the amount of the first fluid that circulates in the primary-side cycle 20. The primary-side expansion valve 31 also decompresses the first fluid.

The secondary-side expansion valve 32 adjusts the amount of the second fluid that circulates in the secondary-side cycle 40. The secondary-side expansion valve 32 also decompresses the second fluid.

The compressor 33 sucks and compresses low-pressure gas refrigerant that is the second fluid and discharges high-pressure gas refrigerant. The four-way switching valve 34 functions as a switching device and makes connection indicated by the solid lines in FIG. 1 during cooling operation and connection indicated by the broken lines in FIG. 1 during heating operation.

The cascade heat exchanger 35 exchanges heat between the first fluid and the second fluid. The cascade heat exchanger 35 is, for example, a plate heat exchanger. The cascade heat exchanger 35 includes a first fluid passage 351 and a second fluid passage 352. The first fluid passage 351 allows the first fluid to pass therethrough. The second fluid passage 352 allows the second fluid to pass therethrough. The cascade heat exchanger 35 functions as an evaporator for the first fluid and a condenser for the second fluid during cooling operation and functions as a condenser for the first fluid and an evaporator for the second fluid during heating operation.

The liquid shutoff valve 38 and the gas shutoff valve 39 shut off a flow path in which the second fluid circulates, for example, during work of installation of the cascade unit 30.

(2-3) Usage Unit 50

The usage unit 50 is configured to supply cold or heat to a user. The usage unit 50 includes a usage heat exchanger 51 and a usage expansion valve 52. The usage heat exchanger 51 is configured to cause cold or heat to be used by a user. The usage heat exchanger 51 is a microchannel heat exchanger and includes a flat multi-hole pipe 51*a*. The flat multi-hole pipe includes, for example, a refrigerant flow path having a hole diameter of 0.05 mm or more and 2.0 mm or less. The usage expansion valve 52 adjusts the amount of the second fluid that circulates in the secondary-side cycle 40. The usage expansion valve 52 also functions as a decompression device that decompresses the second fluid.

(3) Operation (3-1) Cooling Operation (3-1-1) Operation of Primary-Side Cycle 20

The compressor 11 sucks low-pressure gas refrigerant that is the first fluid and discharges high-pressure gas refrigerant. The high-pressure gas refrigerant reaches the heat-source heat exchanger 13 via the four-way switching valve 12. The heat-source heat exchanger 13 condenses the high-pressure gas refrigerant and thereby produces high-pressure liquid refrigerant. At this time, the refrigerant that is the first fluid releases heat into outside air. The high-pressure liquid refrigerant passes through the heat-source expansion valve 14 that is fully opened, passes through the subcooling heat exchanger 16, and reaches the primary-side expansion valve 31 via the liquid shutoff valve 18. The primary-side expansion valve 31 whose opening degree is appropriately set decompresses the high-pressure liquid refrigerant and thereby produces low-pressure gas-liquid two-phase refrigerant. The low-pressure gas-liquid two-phase refrigerant enters the first fluid passage 351 of the cascade heat exchanger 35. The cascade heat exchanger 35 evaporates the low-pressure gas-liquid two-phase refrigerant and thereby produces low-pressure gas refrigerant. At this time, the first fluid absorbs heat from the second fluid. The low-pressure gas refrigerant exits the first fluid passage 351, passes through the gas shutoff valve 19, and is sucked by the compressor 11 via the four-way switching valve 12.

A portion of the high-pressure liquid refrigerant that has exited the heat-source expansion valve 14 is decompressed by the subcooling expansion valve 15 whose opening degree is appropriately set, and becomes gas-liquid two-phase cooling gas. The cooling gas passes through the subcooling heat exchanger 16. At this time, the cooling gas cools the high-pressure liquid refrigerant and thereby gives a degree of subcooling. The cooling gas exits the subcooling heat exchanger 16, mixes with the low-pressure gas refrigerant that comes from the four-way switching valve 12, and is sucked by the compressor 11.

(3-1-2) Operation of Secondary-Side Cycle 40

The compressor 33 sucks low-pressure gas refrigerant that is the second fluid and discharges high-pressure gas refrigerant. The high-pressure gas refrigerant enters the second fluid passage 352 of the cascade heat exchanger 35 via the four-way switching valve 34. The cascade heat exchanger 35 condenses the high-pressure gas refrigerant and thereby produces high-pressure liquid refrigerant. At this time, the second fluid releases heat into the first fluid. The high-pressure liquid refrigerant exits the second fluid passage 352, passes through the liquid shutoff valve 38, and reaches the secondary-side expansion valve 32. The secondary-side expansion valve 32 whose opening degree is appropriately set decompresses the high-pressure liquid refrigerant and thereby produces low-pressure gas-liquid two-phase refrigerant. The low-pressure gas-liquid two-phase refrigerant reaches the usage expansion valve 52. The usage expansion valve whose opening degree is appropriately set further reduces the pressure of the low-pressure gas-liquid two-phase refrigerant. The low-pressure gas-liquid two-phase refrigerant reaches the usage heat exchanger 51. The usage heat exchanger 51 evaporates the low-pressure gas-liquid two-phase refrigerant and thereby produces low-pressure gas refrigerant. At this time, the refrigerant that is the second fluid absorbs heat from an environment in which a user is present. The low-pressure gas refrigerant exits the usage heat exchanger 51, passes through the gas shutoff valve 39, and is sucked by the compressor 33 via the four-way switching valve 12.

(3-2) Heating Operation (3-2-1) Operation of Primary-Side Cycle 20

The compressor 11 sucks low-pressure gas refrigerant that is the first fluid and discharges high-pressure gas refrigerant. The high-pressure gas refrigerant passes through the gas shutoff valve 19 via the four-way switching valve 12 and enters the first fluid passage 351 of the cascade heat exchanger 35. The cascade heat exchanger 35 condenses the high-pressure gas refrigerant and thereby produces high-pressure liquid refrigerant. At this time, the first fluid releases heat into the second fluid. The high-pressure liquid refrigerant passes through the primary-side expansion valve 31 that is fully opened, then passes through the liquid shutoff valve 18 and the subcooling heat exchanger 16, and reaches the heat-source expansion valve 14. The heat-source expansion valve 14 whose opening degree is appropriately set decompresses the high-pressure liquid refrigerant and thereby produces low-pressure gas-liquid two-phase refrigerant. The low-pressure gas-liquid two-phase refrigerant reaches the heat-source heat exchanger 13. The heat-source heat exchanger 13 evaporates the low-pressure gas-liquid two-phase refrigerant and thereby produces low-pressure gas refrigerant. At this time, the refrigerant that is the first fluid absorbs heat from outside air. The low-pressure gas refrigerant passes through the four-way switching valve 12 and is sucked by the compressor 11.

(3-2-2) Operation of Secondary-Side Cycle 40

The compressor 33 sucks low-pressure gas refrigerant that is the second fluid and discharges high-pressure gas refrigerant. The high-pressure gas refrigerant passes through the gas shutoff valve 39 via the four-way switching valve 34 and reaches the usage heat exchanger 51. The usage heat exchanger 51 condenses the high-pressure gas refrigerant and thereby produces high-pressure liquid refrigerant. At this time, the refrigerant that is the second fluid releases heat into an environment in which a user is present. The high-pressure liquid refrigerant reaches the usage expansion valve 52. The usage expansion valve 52 whose opening degree is appropriately set decompresses the high-pressure liquid refrigerant and thereby produces low-pressure gas-liquid two-phase refrigerant. The low-pressure gas-liquid two-phase refrigerant passes through the liquid shutoff valve 38 and reaches the secondary-side expansion valve 32. The secondary-side expansion valve 32 whose opening degree is appropriately set further reduces the pressure of the low-pressure gas-liquid two-phase refrigerant. The low-pressure gas-liquid two-phase refrigerant enters the second fluid passage 352 of the cascade heat exchanger 35. The cascade heat exchanger 35 evaporates the low-pressure gas-liquid two-phase refrigerant and thereby produces low-pressure gas refrigerant. At this time, the second fluid absorbs heat from the first fluid. The low-pressure gas refrigerant exits the second fluid passage 352, passes through the four-way switching valve 34, and is sucked by the compressor 33.

(4) Specifications of Heat Exchanger

The capacity of the usage heat exchanger 51 is a first capacity V1. The capacity of the second fluid passage 352 of the cascade heat exchanger 35 is a second capacity V2. The relationship between the first capacity V1 and the second capacity V2 is as follows.

$$0.80 \le \frac{V1}{V2} \le 1.20$$

The relationship between the first capacity V1 and the second capacity V2 may be as follows.

$$0.90 \le \frac{V1}{V2} \le 1.10$$

(5) Features (5-1)

The usage heat exchanger 51 includes a flat multi-hole pipe 51*a*. Heat exchangers of a type that includes a flat multi-hole pipe 51*a* tend to have a small capacity. Therefore, a difference between the capacity of the cascade heat exchanger 35 and the capacity of the usage heat exchanger 51 is small. It is thus possible to reduce the amount of refrigerant charged into the refrigerant cycle system 100.

(5-2)

The flat multi-hole pipe 51*a* of the usage heat exchanger 51 includes a refrigerant flow path having a hole diameter of 0.05 mm or more and 2.0 mm or less. The capacity of the usage heat exchanger 51 thus tends to be small. Therefore, a difference between the capacity of the cascade heat exchanger 35 and the capacity of the usage heat exchanger 51 is small. It is thus possible to reduce the amount of refrigerant charged into the refrigerant cycle system 100.

(5-3)

The cascade heat exchanger 35 is a plate heat exchanger. Therefore, heat can be exchanged efficiently between the first fluid and the second fluid.

(5-4)

The relationship between the first capacity V1 and the second capacity V2 is as follows.

$$0.80 \le \frac{V1}{V2} \le 1.20$$

Therefore, a difference between the capacity of the cascade heat exchanger 35 and the capacity of the usage heat exchanger 51 is small. It is thus possible to reduce the amount of refrigerant charged into the refrigerant cycle system 100.

(6) Modifications

The number of the usage unit 50 is one in the embodiments described above. Instead of this, the number of the usage units may be two or more. In this case, the first capacity V1 in the aforementioned mathematical expression is a sum total of the capacities of usage heat exchangers of all of the usage units.

Second Embodiment (1) Overall Configuration

Figure 2:
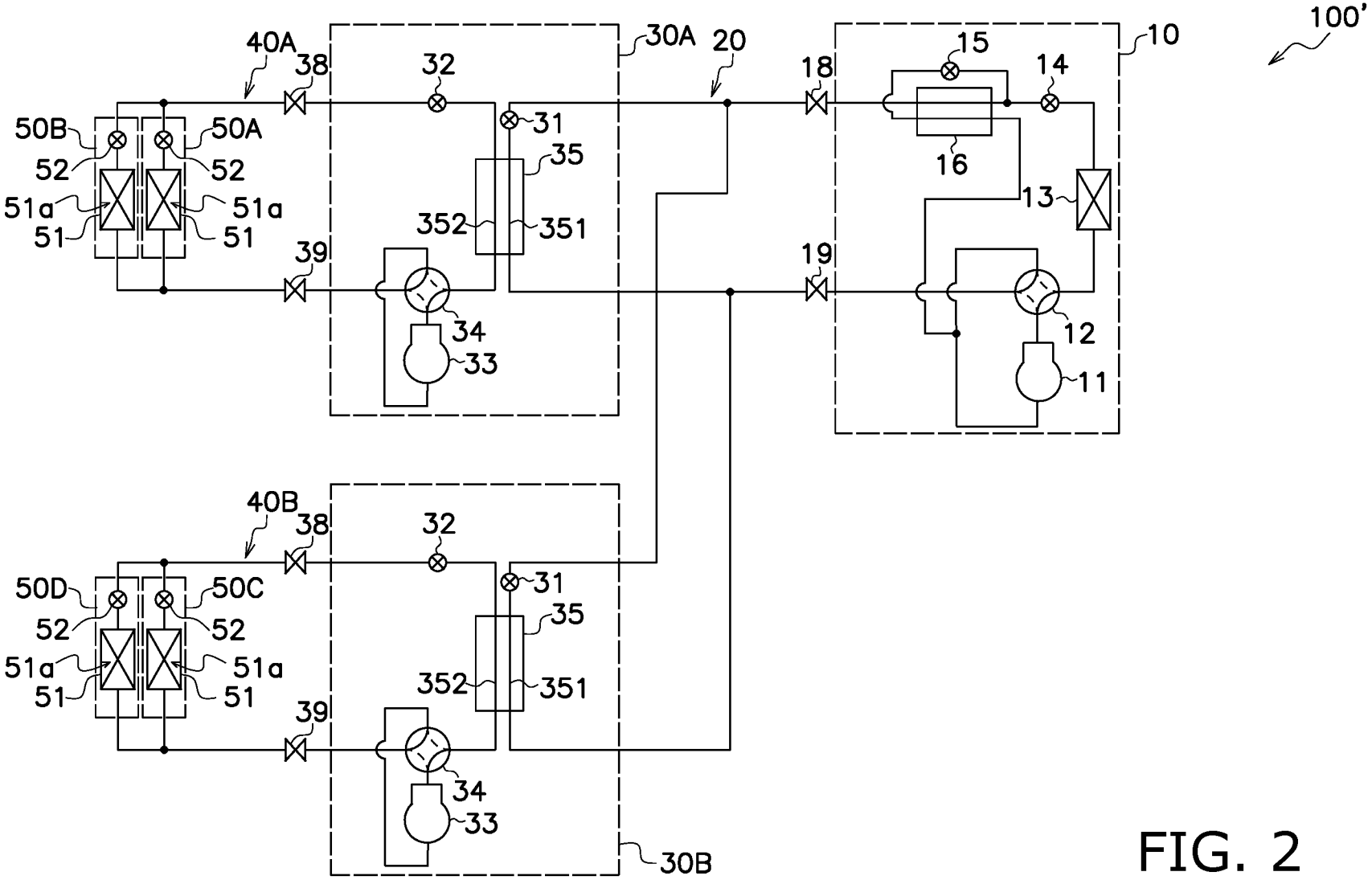
FIG. 2 is a view illustrating a refrigerant cycle system 100' according to a second embodiment.

FIG. 2 illustrates a refrigerant cycle system 100'. The refrigerant cycle system 100' differs from the first embodiment in that the refrigerant cycle system 100' includes one heat source unit 10, two cascade units 30A and 30B, and four usage units 50A, 50B, 50C, and 50D.

The heat source unit 10 and the cascade units 30A and 30B are connected to each other to constitute a vapor compression primary-side cycle 20. The primary-side cycle 20 is a circuit that circulates a first fluid. The first fluid is a refrigerant.

The cascade unit 30A and the usage units 50A and 50B are connected to each other to configure a vapor compression secondary-side cycle 40A. The cascade unit 30B and the usage units 50C and 50D are connected to each other to configure another vapor compression secondary-side cycle 40B. The secondary-side cycles 40A and 40B are circuits that circulate the second fluid. The second fluid is a refrigerant. The first fluid and the second fluid may be the same refrigerant and may be different refrigerants.

(2) Detailed Configuration (2-1) Heat Source Unit 10

The heat source unit 10 has the same configuration as that of the heat source unit 10 of the first embodiment.

(2-2) Cascade Units 30A and 30B

The cascade units 30A and 30B each have the same configuration as that of the cascade unit 30 of the first embodiment.

The first cascade unit 30A includes a cascade heat exchanger 35. The capacity of the second fluid passage 352 of the cascade heat exchanger 35 is V21.

The second cascade unit 30B includes a cascade heat exchanger 35. The capacity of the second fluid passage 352 of the cascade heat exchanger 35 is V22.

Here, the second capacity V2, which is the sum total of the capacities of the second fluid passages 352 of all of the cascade heat exchangers 35, is as follows.

$$V2=V21+V22$$

(2-3) Usage Units 50A, 50B, 50C, and 50D

The usage units 50A, 50B, 50C, and 50D each have the same configuration as that of the usage unit 50 of the first embodiment.

The first usage unit 50A includes a usage heat exchanger 51. The capacity of the usage heat exchanger 51 is V11.

The second usage unit 50B includes a usage heat exchanger 51. The capacity of the usage heat exchanger 51 is V12.

The third usage unit 50C includes a usage heat exchanger 51. The capacity of the usage heat exchanger 51 is V13.

The fourth usage units 50D includes a usage heat exchanger 51. The capacity of the usage heat exchanger 51 is V14.

Here, the first capacity V1, which is a sum total of the capacities of all of the usage heat exchangers 51, is as follows.

$$V1=V11+V12+V13+V14$$

(3) Specifications of Heat Exchanger (3-1) First Secondary-Side Cycle 40A

The capacities of the heat exchangers are designed to satisfy the following relationship.

$$0.80 \le \frac{V11+V12}{V21} \le 1.20$$

The capacities of the heat exchangers may be designed to satisfy the following relationship.

$$0.90 \le \frac{V11+V12}{V21} \le 1.10$$

(3-2) Second Secondary-Side Cycle 40B

The capacities of the heat exchangers are designed to satisfy the following relationship.

$$0.80 \le \frac{V13+V14}{V22} \le 1.20$$

The capacities of the heat exchangers may be designed to satisfy the following relationship.

$$0.90 \le \frac{V13+V14}{V22} \le 1.10$$

(3-3) Entirety of Refrigerant Cycle System 100'

The capacities of the heat exchangers are designed to satisfy the following relationship.

$$0.80 \le \frac{V1}{V2} \le 1.20$$

The capacities of the heat exchangers may be designed to satisfy the following relationship.

$$0.90 \le \frac{V1}{V2} \le 1.10$$

(4) Features

In the second embodiment, the usage heat exchanger 51 and the cascade heat exchanger 35 that are used in the first embodiment are used for a plurality of the secondary-side cycles 40A and 40B. Therefore, a difference between the capacities of the cascade heat exchangers 35 and the capacities of the usage heat exchangers 51 is small. It is thus possible to reduce the amount of refrigerant charged into the refrigerant cycle system 100.

(5) Modification (5-1) Modification 2A

The number of the cascade units 30A and 30B is two in the embodiments described above. Instead of this, the number of the cascade units may be three or more.

(5-2) Modification 2B

In the embodiments described above, the four usage heat exchangers 51 included in the usage units 50A, 50B, 50C, and 50D each have a flat multi-hole pipe 51*a* as with the first embodiment. Instead of this, some of the four usage heat exchangers 51 may each have a flat multi-hole pipe 51*a*, and some of the four usage heat exchangers 51 may be cross-fin heat exchangers.

(5-3) Modification 2C

Each modification of the first embodiment may be applied to the second embodiment.

CONCLUSION

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

10 heat source unit
20 primary-side cycle
30 cascade unit
30A cascade unit
30B cascade unit
35 cascade heat exchanger
35A cascade heat exchanger
35B cascade heat exchanger
40 secondary-side cycle
40A secondary-side cycle
40B secondary-side cycle
50 usage unit
50A usage unit
50B usage unit
50C usage unit
50D usage unit
51 usage heat exchanger (secondary-side heat exchanger)
351 first fluid passage
352 second fluid passage
V1 first capacity
V2 second capacity

PATENT LITERATURE

PTL 1: Japanese Laid-Open Patent Publication No. 2014-74508

The invention claimed is:

1. A refrigerant cycle system comprising:

a primary-side cycle of a vapor compression type that circulates a first refrigerant;

a secondary-side cycle of a vapor compression type that circulates a second refrigerant; and a cascade heat exchanger that exchanges heat between the first refrigerant and the second refrigerant, wherein the secondary-side cycle comprises a secondary-side heat exchanger disposed indoor and that uses cold or heat obtained by the second refrigerant from the cascade heat exchanger, the secondary-side heat exchanger comprises a flat multi-hole pipe, the cascade heat exchanger is a plate heat exchanger, the cascade heat exchanger comprises:

a first refrigerant passage that allows the first refrigerant to pass; and a second refrigerant passage that allows the second refrigerant to pass, and a first volume V1 of the secondary-side heat exchanger and a second volume V2 of the second refrigerant passage satisfies $0.80 \leq V1/V2 \leq 1.20$.

2. The refrigerant cycle system according to claim 1, wherein the flat multi-hole pipe comprises a refrigerant flow path having a hole diameter of 0.05 mm or more and 2.0 mm or less.

3. A refrigerant cycle system comprising:

a primary-side cycle of a vapor compression type that circulates a first refrigerant;

secondary-side cycles of a vapor compression type that each circulate a respective second refrigerant; and cascade heat exchangers that each exchange heat between the first refrigerant and the respective second refrigerant, wherein each of the secondary-side cycles comprises a secondary-side heat exchanger comprising a flat multi-hole pipe and disposed indoor and that uses cold or heat obtained by the respective second refrigerant from a corresponding one of the cascade heat exchangers, each of the cascade heat exchangers is a plate heat exchanger, each of the cascade heat exchangers comprises:

a first refrigerant passage that allows the first refrigerant to pass; and a second refrigerant passage that allows the respective second refrigerant to pass, and for each of the secondary-side cycles, a first volume V1 of the secondary-side heat exchanger and a second volume V2 of the second refrigerant passage satisfies $0.80 \leq V1/V2 \leq 1.20$.

* * * * *